US008302771B2

(12) United States Patent
Arslan

(10) Patent No.: US 8,302,771 B2
(45) Date of Patent: Nov. 6, 2012

(54) TOOLBOX

(76) Inventor: Yavuz Arslan, Barsbuettel (DE)

( * ) Notice: Subject to any disclaimer, the term of this patent is extended or adjusted under 35 U.S.C. 154(b) by 0 days.

(21) Appl. No.: 13/006,649

(22) Filed: Jan. 14, 2011

(65) Prior Publication Data

US 2012/0181199 A1 Jul. 19, 2012

(51) Int. Cl.
*B65D 85/20* (2006.01)
*B25H 3/00* (2006.01)

(52) U.S. Cl. ..... 206/372; 206/373; 206/759; 206/379

(58) Field of Classification Search ..... 206/372, 206/373, 376, 377, 378, 379, 752, 736, 349, 206/745, 759, 747; 211/70.6
See application file for complete search history.

(56) References Cited

U.S. PATENT DOCUMENTS 6,415,923 B1 * 7/2002 Chen ..... 206/379
6,547,074 B1 * 4/2003 Chen ..... 206/379
7,032,483 B2 * 4/2006 Liu ..... 81/490
7,168,559 B2 * 1/2007 Chen ..... 206/373
7,270,235 B2 * 9/2007 Chen ..... 206/379
7,624,863 B2 * 12/2009 Meng ..... 206/349
7,661,526 B2 * 2/2010 Lin ..... 206/379
7,699,176 B2 * 4/2010 Lin ..... 206/759
8,016,108 B1 * 9/2011 Hung ..... 206/379
2005/0056559 A1 * 3/2005 Chen ..... 206/372
2005/0056560 A1 * 3/2005 Chen ..... 206/373
2006/0016706 A1 * 1/2006 Chen ..... 206/379
2006/0118446 A1 * 6/2006 Liu ..... 206/373

* cited by examiner

*Primary Examiner* — Steven A. Reynolds
(74) *Attorney, Agent, or Firm* — Rosenberg, Klein & Lee

(57) ABSTRACT

A toolbox includes a housing defining therein multiple storage chambers, multiple tool holders respectively pivotally mounted in the storage chambers for holding tool elements, a drive gear pivotally mounted on one end of the housing and coupled to one end of one tool holder, crank arms coupled to the drive gear, and links respectively coupled between the crank arms and the other tool holders for enabling the other tool holders to be synchronously biased relative to the housing during rotation of the drive gear to bias the associating tool holder relative to the housing.

2 Claims, 5 Drawing Sheets

TOOLBOX

BACKGROUND OF THE INVENTION

1. Field of the Invention

The present invention relates to a toolbox for storing tool elements, and more particularly, to a toolbox, which facilitates arrangement and use of tool elements.

2. Description of the Related Art

Many different toolboxes for holding tool elements (driver bits, connectors, and etc.) are commercially available. These conventional toolboxes commonly comprise a box body made in any of a variety of shapes for holding tool elements and a box cover for closing the box body to prohibit falling of the storage tool elements from the box body. When picking up a storage tool element from a toolbox or storing a tool element in the toolbox, the user must open the box cover from the box body. After each use, the user must close the box cover on the box body again. It is inconvenient to frequently open and close the box cover.

SUMMARY OF THE INVENTION

The present invention has been accomplished under the circumstances in view. It is the main object of the present invention to provide a toolbox, which facilitates arrangement and use of tool elements.

To achieve this and other objects of the present invention, a toolbox comprises a housing defining therein multiple storage chambers, multiple tool holders respectively pivotally mounted in the storage chambers for holding tool elements, a drive gear pivotally mounted on one end of the housing and coupled to one end of one tool holder, crank arms coupled to the drive gear, and links respectively coupled between the crank arms and the other tool holders for enabling the other tool holders to be synchronously biased relative to the housing during rotation of the drive gear to bias the associating tool holder relative to the housing.

DETAILED DESCRIPTION OF THE PREFERRED EMBODIMENT

Figure 1:
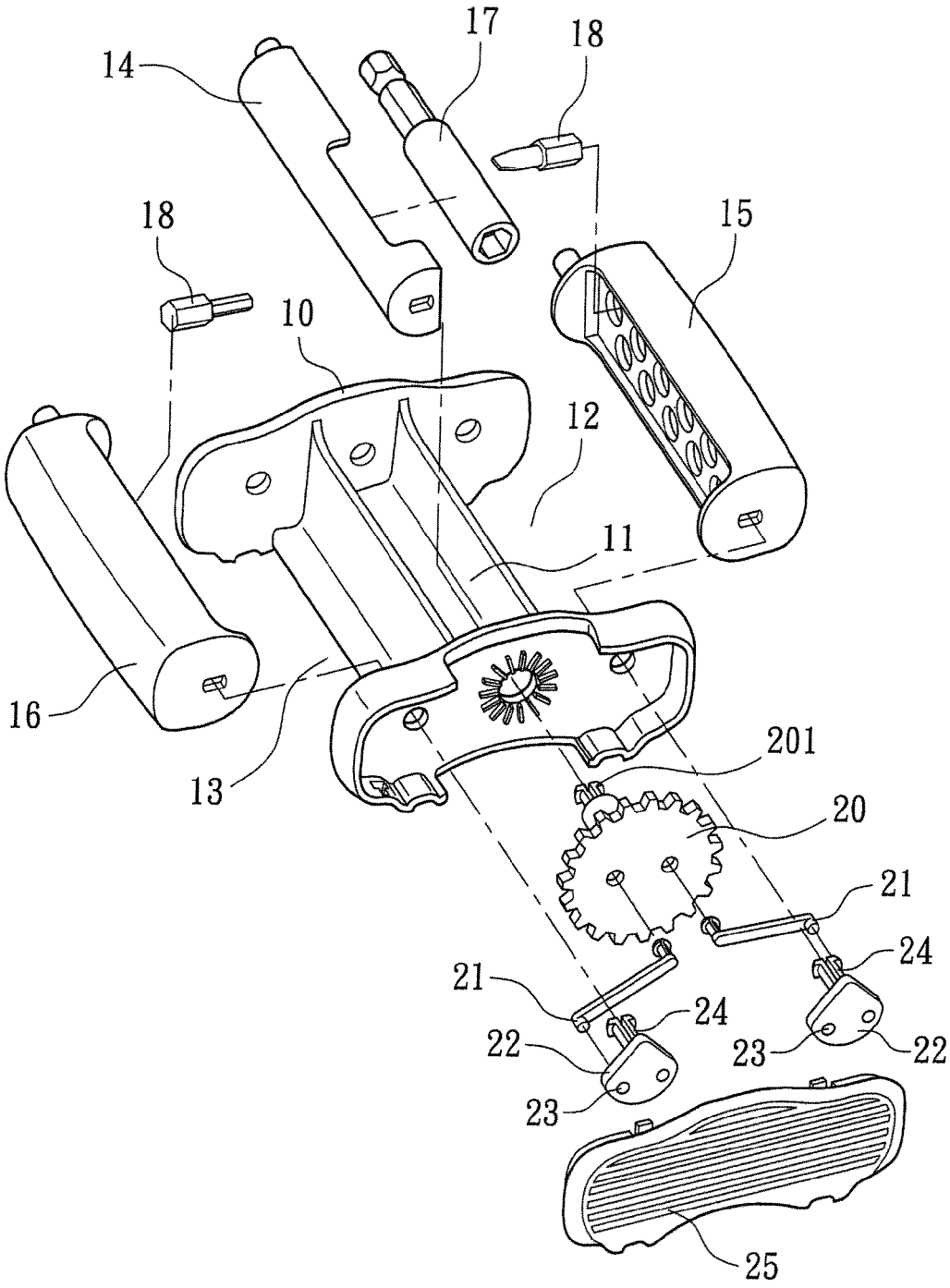
FIG. 1 is an exploded view of a toolbox in accordance with a first embodiment of the present invention.
Figure 2:
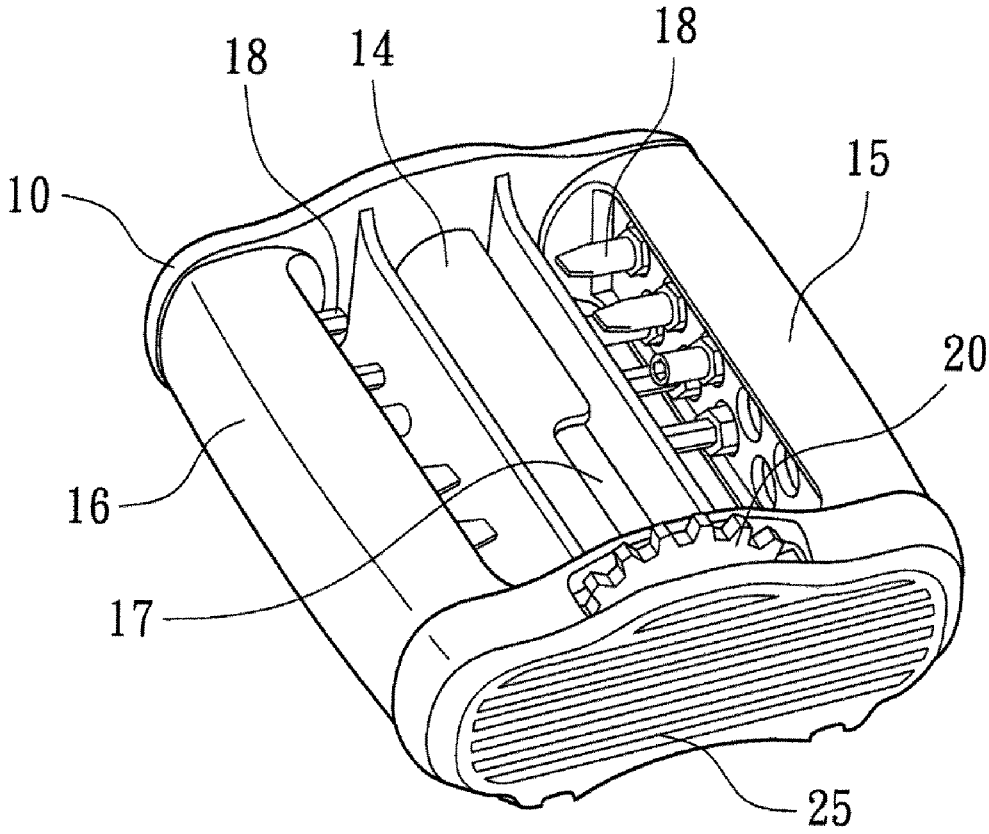
FIG. 2 is an elevational assembly view of the toolbox in accordance with the first embodiment of the present invention.

Referring to FIGS. 1-6, a toolbox in accordance with a first embodiment of the present invention is shown comprising a housing 10 that defines therein a first storage chamber 11, a second storage chamber 12 and a third storage chamber 13, a first tool holder 14, a second tool holder 15 and a third tool holder 16 respectively pivotally mounted in the first storage chamber 11, the second storage chamber 12 and the third storage chamber 13 for storing tool elements 17;18, a drive gear 20 pivotally mounted on one end of the housing 10 and having a gear shaft 201 connected to one end of the first tool holder 14, two links 22 respectively pivotally mounted on the same end of the housing 10 at two opposite lateral sides relative to the drive gear 20 and having a respective coupling shaft 24 respectively coupled to one end of the second tool holder 15 and one end of the third tool holder 16, two crank arms 21 respectively coupled between the drive gear 20 and a respective eccentric coupling hole 23 on each of the links 22, and a cover plate 25 covering one end of the housing 10 over the drive gear 20, the crank arms 21 and the links 22.

Figure 3:
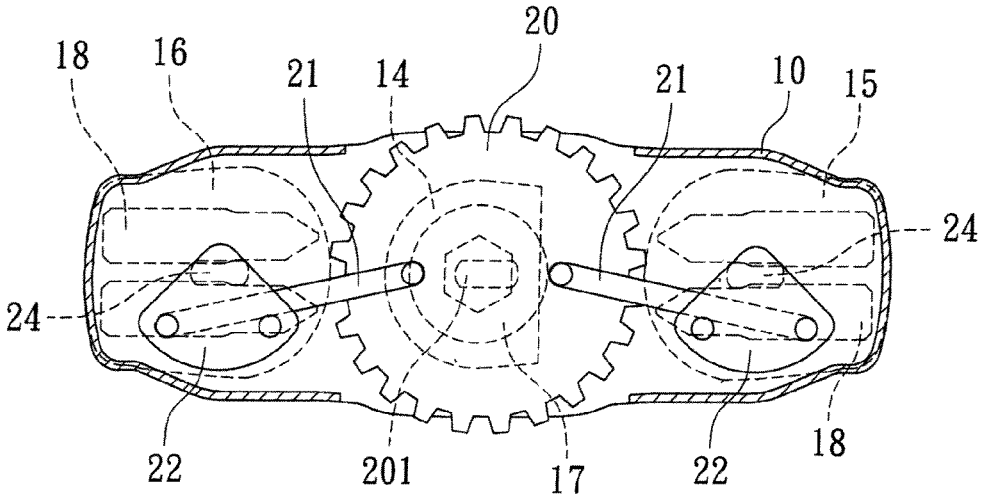
FIG. 3 is a cross sectional view of the first embodiment of the present invention, illustrating the storage tool elements concealed inside the housing of the toolbox.
Figure 4:
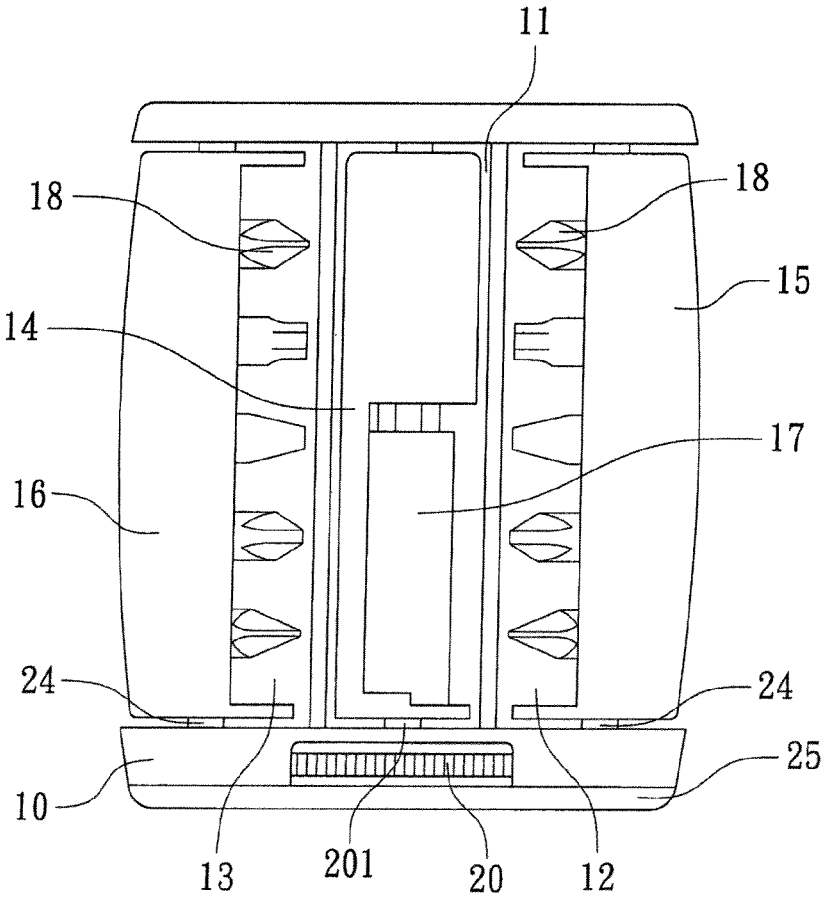
FIG. 4 is a top plain view of FIG. 3.
Figure 5:
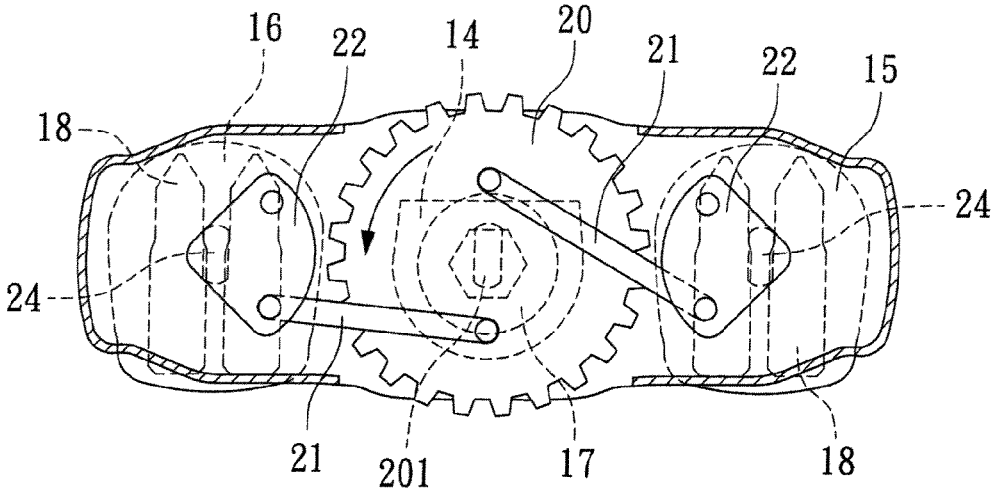
FIG. 5 corresponds to FIG. 3 illustrating the storage tool elements exposed to the outside of the housing of the toolbox.
Figure 6:
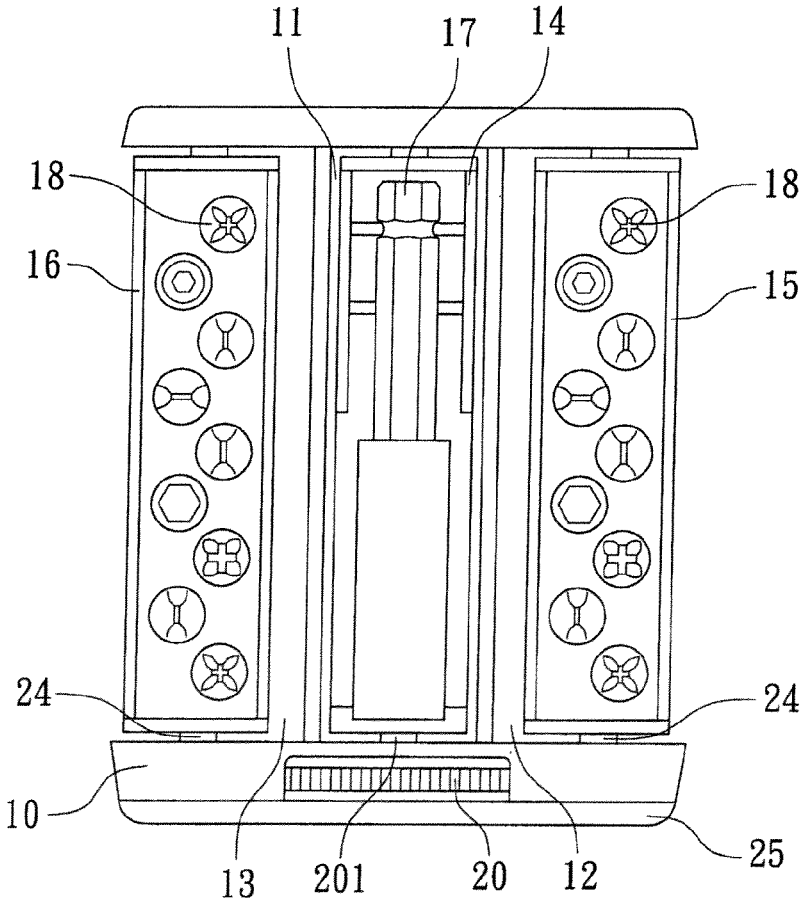
FIG. 6 is a top plain view of FIG. 5.

Normally, as shown in FIGS. 3 and 4, the first, second and third tool holders 14;15;16 are kept in a respective sideward position to conceal the storage tool elements 17;18 in the housing 10. When rotating the drive gear 20 in one direction (the counter-clockwise direction), the crank arms 21 are forced to bias the links 22 through an angle, and therefore the first, second and third tool holders 14;15;16 are biased with the links 22 to expose the storage tool elements 17;18 to the outside of the housing 10, as shown in FIGS. 5 and 6. When wishing to receive the storage tool elements 17;18 to the inside of the housing 10, reverse the drive gear 20 again. Thus, the user can store tool elements 17;18 and use storage tool elements 17;18 conveniently.

Figure 7:
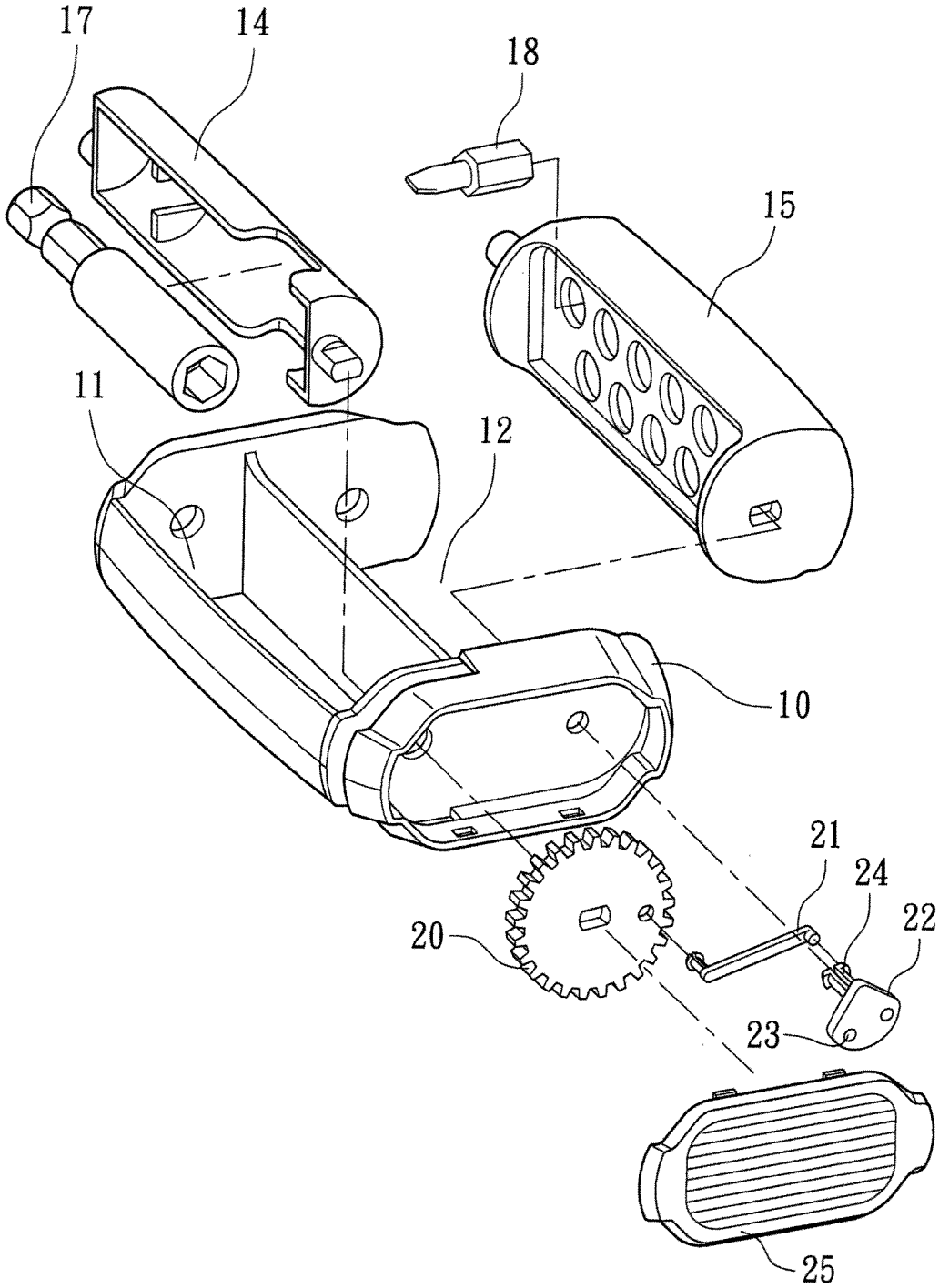
FIG. 7 is an exploded view of a toolbox in accordance with a second embodiment of the present invention.

FIG. 7 shows a toolbox in accordance with a second embodiment of the present invention. This second embodiment is substantially similar to the aforesaid first embodiment with the exception that the housing 10 simply defines therein two storage chambers 11;12 for holding two tool holders 14;15, and only one crank arm 21 and one link 22 are used with the drive gear 20 for rotating the tool holders 14;15 between a received position and an exposed position.

The operation of this second embodiment is same as that of the aforesaid first embodiment.

Although particular embodiments of the invention have been described in detail for purposes of illustration, various modifications and enhancements may be made without departing from the spirit and scope of the invention.

What the invention claimed is:

1. A toolbox comprising:

a housing, said housing defining therein a first storage chamber on a middle position, and a second storage chamber and a third storage chamber at two opposite lateral sides relative to said first storage chamber;

a first tool holder pivotally mounted in said first storage chamber for holding tool elements;

a second tool holder pivotally mounted in said second storage chamber for holding tool elements;

a third tool holder pivotally mounted in said third storage chamber for holding tool elements;

a drive gear pivotally mounted on a first end of said housing and coupled to a first end of said first tool holder for rotating said first tool holder relative to said housing;

two crank arms each pivotally coupled to said drive gear to extend eccentrically therefrom;

two links respectively coupled to said crank arms and said second tool holder and said third tool holder for enabling said second and third tool holders to be synchronously biased relative to said housing during rotation of said drive gear to bias said first tool holder relative to said housing; and a cover covered on said first end of said housing to protect said drive gear, said crank arms and said links.

2. A toolbox comprising:

a housing, said housing defining therein a first storage chamber and a second storage chamber;

a first tool holder pivotally mounted in said first storage chamber for holding tool elements;

a second tool holder pivotally mounted in said second storage chamber for holding tool elements;

a drive gear pivotally mounted on a first end of said housing and coupled to a first end of said first tool holder for rotating said first tool holder relative to said housing;

a crank arm pivotally coupled to said drive gear to extend eccentrically therefrom;

a link coupled to said crank arm and said second tool holder for enabling said second tool holder to be synchronously biased relative to said housing during rotation of said drive gear to bias said first tool holder relative to said housing; and a cover covered on said first end of said housing to protect said drive gear, said crank arm and said link.

* * * * *